United States Patent [19]

Hallberg et al.

[11] 4,343,287

[45] Aug. 10, 1982

[54] CRYSTAL CLEAVING MACHINE

[75] Inventors: Frederick C. Hallberg, Wheaton, Md.; John S. J. Benedicto, Falls Church, Va.

[73] Assignee: The United States of America as represented by the Administrator of the National Aeronautics and Space Administration, Washington, D.C.

[21] Appl. No.: 182,879

[22] Filed: Aug. 29, 1980

[51] Int. Cl.[3] ..... B28D 1/32

[52] U.S. Cl. ..... 125/23 R; 225/103

[58] Field of Search ..... 225/103, 104, 105; 125/23 R, 23 C

[56] References Cited

U.S. PATENT DOCUMENTS

| | | | |
|---|---|---|---|
| 304,858 | 9/1884 | Reichardt | 125/23 R |
| 1,084,827 | 1/1914 | Sudre | 125/23 R |
| 1,094,177 | 4/1914 | Sudre | 125/23 R |
| 1,353,367 | 9/1920 | Whipple | 125/23 R |
| 2,582,694 | 1/1952 | Gundlach | 125/23 R |
| 3,187,739 | 6/1985 | Du Fresne | 125/23 R |
| 3,901,423 | 8/1975 | Hillberry | 125/23 R |
| 4,184,472 | 1/1980 | Benedicto | 125/23 R |

*Primary Examiner*—Harold D. Whitehead

*Attorney, Agent, or Firm*—John O. Tresansky; John R. Manning; Ronald F. Sandler

[57] ABSTRACT

A machine is disclosed for cleaving hard crystals (40), a typical example of which is lithium fluoride, with precision and uniformity and includes vertical axis positioning control means (12) for an adjustable spring tension guided hammer mechanism (17, 18) employed to strike an anvil (21) and thereby generate a crystal cleaving shock wave transmitted to a cleaving blade (23) having an angulated cleaving edge 24 in contact with one corner of the crystal (40). Connection between the anvil 21 and the blade is by means of a pair of vertical shafts (20) held in substantially friction free engagement by two pairs of adjustable linear bearings (19). An underlying crystal holding fixture (38) with horizontal position control means (14) includes a zero reference stop face (42) for the crystal (40) and opposing spring-loaded clamping and vertical positioning elements (43, 44) which are precisely guided. The crystal (40) is restrained only to the extent that it remains in an ideal position for cleaving until the shock wave begins to propagate along a cleavage plane. Thus the shock wave forces that separate the crystal are balanced and the light restraining force used to hold the crystal allows it to splay apart with minimal shock wave damping.

24 Claims, 5 Drawing Figures

CRYSTAL CLEAVING MACHINE

ORIGIN OF THE INVENTION

The invention described herein was made by an employee(s) of the United States Government and may be manufactured and used by or for the Government for governmental purposes without the payment of any royalties thereon or therefor.

TECHNICAL FIELD

The present invention relates to cleaving apparatus and more particularly to a machine for cleaving hard crystals.

BACKGROUND ART

The present invention has particular utility in cleaving hard crystals into relatively thin segments or slices. A typical example involves cleaving a lithium fluoride crystal into crystal segments having a thickness in the order of 1/32 inch.

In the past such crystals have generally been cleaved by hand methods involving, for example, a sharp blade and hammer but with varying degrees of success. Like diamond cutting, these methods require a skill obtained only through a considerable amount of costly practice. Even under optimum conditions, there existed a certain lack of precision and reliability. Control over the thickness has also been difficult to maintain and as the thickness of a cleaved crystal approaches 1/32 inch, breakage increases rapidly making the resulting yield not only small but relatively costly.

Heretofore the limited demand for extremely thin crystals did not provide a need for a machine to cleave crystals having these thicknesses. However, the crystal requirements for present day specialized optics applications has dictated otherwise.

STATEMENT OF INVENTION

Accordingly it is an object of the present invention to provide apparatus for cleaving hard crystals into thin slices.

Another object of the present invention is to provide apparatus for cleaving hard crystals which results in a relatively high yield of usable crystals.

Yet another object of the present invention is to provide hard crystal cleaving apparatus which minimizes crystal lattice damage.

Still another object of the present invention is to provide hard crystal cleaving apparatus which provides precise control over the production of crystals so that they are free from breaks, cracks, scratches, twists, and large steps between cleavage planes.

Yet another object of the present invention is to provide a hard crystal cleaving apparatus which is capable of being operated by relatively unskilled personnel.

These and other objects are achieved by means of a crystal cleaving machine employing a hammer mechanism which limits the depth of penetration of a cleaving blade brought into contact with a crystal to be cleaved and which controls the magnitude of a cleaving shock wave applied to the crystal, and a holding mechanism which provides for proper positioning of the crystal relative to the cleaving blade and which allows the crystal to splay apart when cleaved with minimal shock wave damping. The crystal is restrained only to the extent that it remains in an ideal position for cleaving until the shock wave begins to propagate along a cleavage plane.

The foregoing as well as other objects, features and advantages of the present invention will become more apparent from the following detailed description taken in conjunction with the appended drawings.

DETAILED DESCRIPTION OF THE INVENTION

Figure 1:
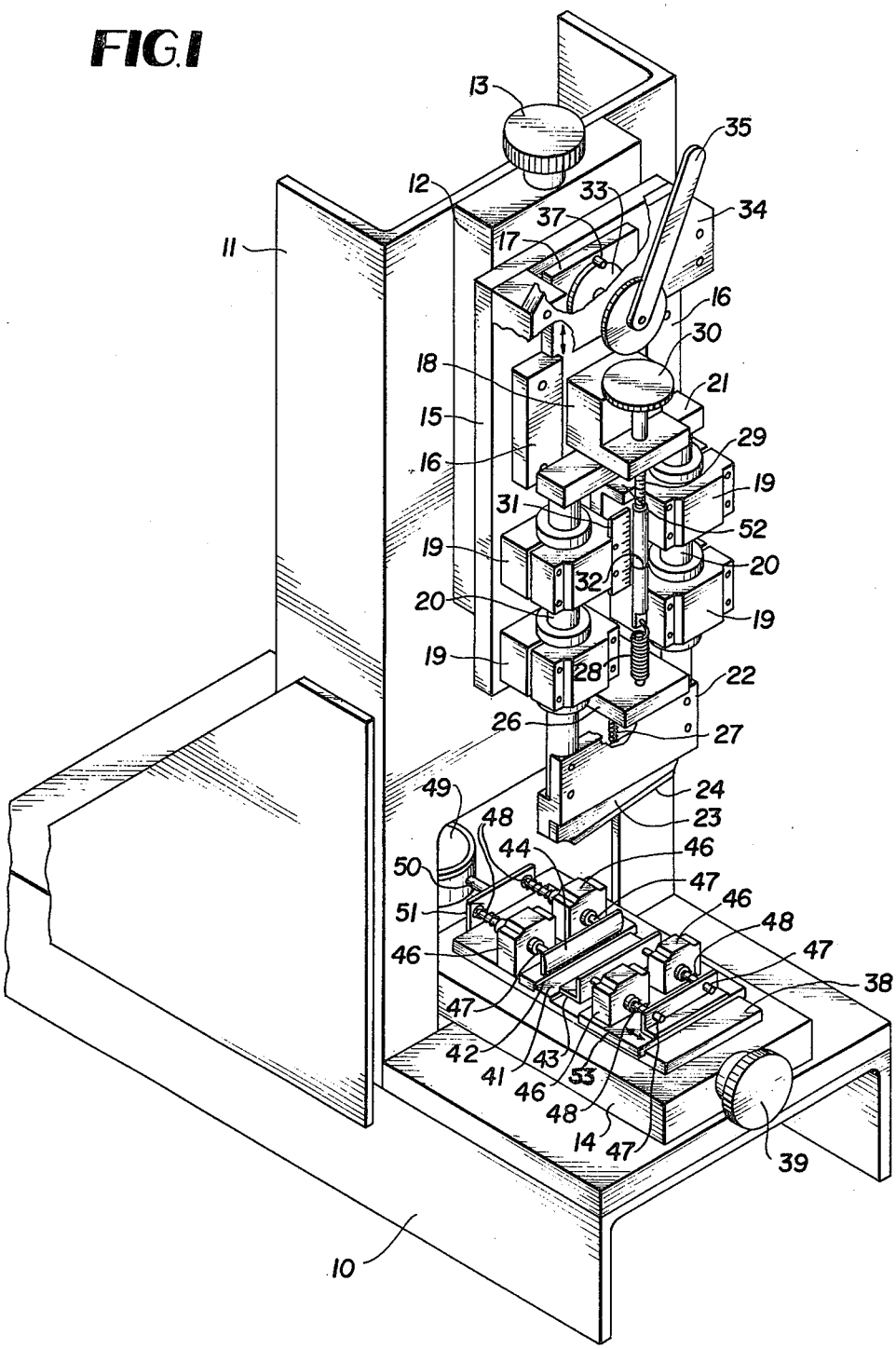
FIG. 1 is a perspective view of a crystal cleaving machine embodying the invention.

Referring now to the drawings wherein like numerals designate like parts, FIG. 1 discloses a crystal cleaving machine according to the invention which includes a level base 10 having a fixed rigid post 11 rising therefrom. A first conventional linear motion positioning control device 12 is suitably fixed to the post 11 with its operational axis vertically disposed under control of a rotary knob 13. A second identical linear motion positioning control device 14 is fixedly attached to the top face of base 10 with its operational axis horizontally disposed at right angles to the axis of the first control device 12. Typically both of the devices 12 and 14 are comprised of commercially available Velmex Unislide devices identified by catalog part Nos. A4009QI and A4006QI, respectively.

A vertical hammer mechanism baseplate 15 is fixedly attached to the position control device 12 and carries on its outer face a pair of vertical parallel spaced guide bars 16 for a vertical reciprocatory slide plate member 17 having an attached hammer body 18 in the form of a stepped block.

Figure 4:
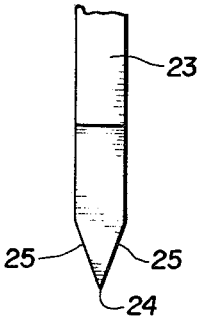
FIG. 4 is an end elevational view of a cleaving blade showing the profile of the blade cleaving edge.
Figure 5:
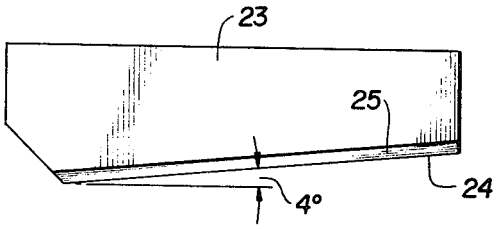
FIG. 5 is a front elevational view of a cleaving blade showing the angulated cleaving edge thereof.

Also fixed on the baseplate 15 are two pairs of parallely aligned vertical axis adjustable linear bearings 19 for a pair of parallel vertical hardened steel shafts 20. A bar type anvil 21 is fixed to the tops of shafts 20 in underlying transverse relationship to the stepped block hammer body 18. A blade holder 22 is similarly fixed to the bottoms of shafts 20 and carries dependingly at its lower extremity a crystal cleaving blade 23, as shown in FIGS. 4 and 5 having an inclined (4°) cleaving edge 24 defined by ground converging flat faces 25, which form an included angle of approximately 60°. The blade 23 is formed of file hard steel or other suitable material.

The bearings 19 provide substantially friction free vertical motion of the cleaving blade 23 without introducing horizontal movement that would break thin crystals. The inclined edge 24 permits commencement of the cleavage at one corner of a crystal by injecting a shock wave, to be described, thereat that propagates through and along a cleavage plane. Depth of blade penetration is also limited, as will be shown, to minimize crystal lattice damage.

The hammer mechanism baseplate 15 carries a horizontally projecting rigid tongue 26 below the lower two linear bearings 19. A counterbalancing retractile spring 27 is connected between this tongue and the blade holder 22 to counterbalance the weight of the cleaving blade, blade holder, shafts 20 and anvil 21.

A hammer actuation tension spring 28, which is adapted to power the downward movement of the hammer block 18 during a cleaving stroke, is connected between the tongue 26 and the lower end of a vertical axis threaded hammer tension control device 29 including a coacting threaded rod and sleeve coupled to a rotatable knob 30 mounted on the hammer block 18. An adjacent hammer tension indicator plate 31 including a scale is provided on one of the upper bearings 19, adjacent the aforementioned sleeve. The scale is calibrated in relation to a mark 32 on the sleeve in terms of grams per thickness of crystal to be cleaved, inasmuch as the magnitude of the impact imparted by the hammer block 18 during a cleaving stroke must be controlled to avoid, at one extreme, shattering of the crystal and at the other extreme, failure to propagate a cleaving shock wave throughout the entire crystal. The magnitude of the impact force is determined experimentally and varies in accordance with the difference in hardness and thickness of the crystal to be cleaved.

Figure 3:
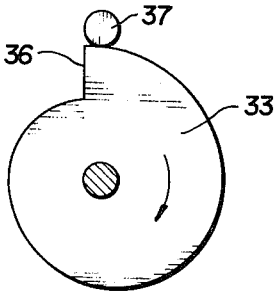
FIG. 3 is a fragmentary elevation view showing the profile of a hammer lifting cam.

A horizontal axis rotary hammer lifting cam 33 is mounted on a frame part 34 attached to base plate 15 and includes a manual operating lever 35. The periphery of the cam 33 is eccentrically formed to elevate the hammer block 18 a predetermined distance during cam rotation, such as ¼ inch. The cam at its highest point has a radial face or shoulder 36. A projecting fixed follower pin 37 on hammer slide plate member 17 rides on the eccentric peripheral face of lifting cam 33 during cam rotation as shown by the arrow in FIG. 3. Upon reaching the shoulder 36, the follower pin 37 drops abruptly and the hammer block 18 descends abruptly under influence of the adjustable tension spring 28 and strikes the anvil 21 generating a shock wave which is transferred to the crystal cleaving blade 24 to cleave the crystal, as will be further described.

A horizontal crystal holder baseplate 38 is fixed to the aforenamed horizontal position control device 14 on the base 10. This latter device has a horizontal axis control knob 39 by means of which the horizontal position of the crystal holding fixture including baseplate 38 can be adjusted with precision similar to the vertical adjustability of the hammer mechanism baseplate 15 by means of adjusting knob 13.

Figure 2:
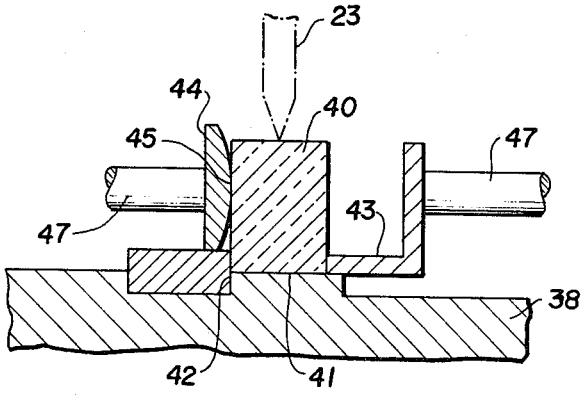
FIG. 2 is an enlarged fragmentary vertical section taken transversely through the crystal holding and positioning means.

As best shown in FIG. 2, a crystal 40 consisting of, for example, lithium fluoride and requiring cleaving rests on a horizontal support surface 41 of baseplate 38 and abuts a shallow vertical zero reference stop surface 42 on the baseplate projecting slightly above the horizontal surface 41. A lightly spring-loaded adjustable clamp 43 engages one side face of the crystal 40 near its bottom face in contact with the surface 41. An opposing lightly spring-loaded vertical positioner 44 having a slightly convex face 45 engages the opposite side face of the crystal body 40 to stabilize the crystal body. This particular crystal holding arrangement is very important in the invention as it leaves the crystal body 40 free to splay apart under the impact force of cleaving blade 23 with little horizontal restraint and minimal shock wave damping. This, in turn, permits the shock wave transmitted to the blade 23 to be injected at the upper corner of the crystal 40 which then propagates downwardly through the crystal cleavage plane in a diagonal direction.

Two pairs of horizontal axis linear bearings 46 for the parallel horizontal stems 47 of vertical positioner 44 and adjustable clamp 43 are affixed to a slidable plate 53 mounted on the fixture baseplate 38. Light loading springs 48 for the respective elements 43 and 44 are provided, as shown.

A dial indicator 49 is suitably attached to the frame of the machine with its displaceable pin 50 engaging a plate 51 rising from the baseplate 38 at the inner end of the same. When the crystal 40 is against the zero reference stop face 42, FIG. 2, the dial indicator 49 will show a zero reading. The horizontal position control knob 39 and dial indicator 49 allow the crystal 40 to be positioned so that one-half of the horizontal crystal thickness will be indicated on the face of the dial indicator. This assures that the cleaving blade cutting edge 24 will engage the crystal body at its thickness midpoint in order to avoid shatter or partial breakage of the crystal due to an imbalance in shock wave forces. When desirable, other types of self centering devices may be used to accurately center and hold the crystal.

OPERATION

The thickness of the crystal body 40 is first accurately measured by a micrometer and the crystal body is placed against the zero reference stop face 42 and between the spring-loaded adjustable clamp 43 and spring-loaded vertical positioner 44 while resting on the support surface 41. The clamp 43 is properly adjusted by movement of the plate 53 to engage the near side surface of the crystal body near its base to avoid tipping of the crystal base during cleavage. The control knob 39 is rotated until the dial indicator 49 indicates one-half of the thickness of the crystal body to be cleaved, thereby providing for a balancing of the shock forces on both half segments of the crystal 40.

After hammer 21 is raised, the control knob 30 is rotated thereby tensioning the spring 28 until the hammer tension indicator 32 reads the proper value for thickness of the crystal to be cleaved. The vertical position control knob 13 is now turned to lower the cleaving blade 23 until its cutting edge 24 makes contact with one upper corner of the crystal 40. The hammer block 18 is now tripped by one stroke of the lifting cam-actuating lever 35. The knob 13 is thereafter turned in the opposite direction to elevate cleaving blade 23 and the cleaved crystal is removed from the machine.

When the tripped hammer block 18 strikes the anvil 21, a shock wave is transmitted via the two shafts 20 to blade holder 22 and blade 23. As noted above, the use of the linear bearings 19 permits nearly friction-free transmission of the shock wave without side movement of the blade 23. Blade penetration into the top of the crystal body is minimal and fixed by a stop element 52 horizontally projecting from the baseplate 15 and located beneath the anvil bar 21. This blade penetration control feature is an important feature of the invention which serves to substantially eliminate crystal lattice damage.

The vertical position control knob 13 allows the cleavage blade 23 to be adjusted for different crystal body heights, as well as allowing the blade 23 to be lowered into contact with the crystal prior to tripping the hammer mechanism to initiate the shock wave thereby to initiate the plane of cleavage.

It should also be noted that the spring-loaded adjustable clamp 43 holds the crystal 40 in the proper position for cleaving while preventing the bottom portion of the crystal 40 from kicking out when the shock wave propagates through the vertical cleavage plane. The four linear bearings 46 provide nearly friction-free movement of the lightly spring-loaded clamp 43 and vertical positioner 44 when the crystal body is cleaved. Thus the crystal is restrained only to the extent that it remains in an ideal position for cleaving until the shock wave begins to propagate along the desired cleavage plane.

Thus what has been shown and described is a relatively simple yet practical machine, operable by relatively unskilled personnel, which is particularly adapted to cleave hard crystal substances such as lithium fluoride. It should be noted, however, the machine is not limited to cleaving lithium fluoride type crystals, but can be used for other hard substances as well, diamonds being a possible candidate. In any event, the quality of the finished product insofar as lithium fluoride crystals are concerned at least, exceeds the quality of crystals produced by highly skilled technicians using hand cleaves.

It is to be understood that the form of the invention herewith shown and described is to be taken as a preferred example of the same, and that various changes in the shape, size and arrangement of parts may be resorted to, without departing from the spirit of the invention or scope of the invention as defined by the appended claims.

We claim:

1. A crystal cleaving machine comprising:

means (38, 42, 43, 44, 53) for holding a crystal (40) to be cleaved;

means (23, 24) for cleaving the held crystal;

means (14) for selectively positioning the held crystal relative to said cleaving means;

biased means (18, 19, 20, 21) for imparting a shock wave to the held crystal by said cleaving means;

means (28, 29, 30) for selectively adjusting the level of bias upon said biased means;

means (12, 13, 15) for effecting contact of said cleaving means with a surface of the held crystal; and means (33, 35, 37, 17) for actuating said biased means to effect impartation of a shock wave to the held crystal by said cleaving means.

2. The cleaving machine as defined by claim 1 wherein said contact effecting means simultaneously positions said cleaving means, biased means, and level of biased establishing means relative to said crystal holding means, and additionally includes means (52) for controlling the depth of penetration of said cleaving means into the held crystal in conjunction with said contact effecting means.

3. The cleaving machine as defined by claim 1 wherein said means for holding said crystal comprises spring-loaded clamp means (44, 43) respectively located on a baseplate (38) and a slidable plate (53) mounted on said baseplate, said clamp means restraining said crystal to the extent that it remains substantially stationary until said shock wave begins to propagate along a cleavage plane.

4. The cleaving machine as defined by claim 3 wherein said baseplate (38) is further mounted on said crystal positioning means (14).

5. The cleaving machine as defined by claim 1 where said cleaving means comprises blade means (23) having a depending edge (24) adapted for contact with one surface of the held crystal.

6. The cleaving machine as defined by claim 5 wherein the edge (24) of said blade means is angulated with respect to said one surface so as to initially contact a corner portion of said held crystal and is thereby operable to couple a shock wave to the crystal which travels in a cleavage plane from said one corner portion toward an opposite diagonal corner portion of the crystal.

7. The cleaving machine as defined by claim 1 wherein said means for imparting said shock wave includes a hammer mechanism (17, 18) and anvil means (19, 20, 21), said hammer mechanism being operable to strike said anvil means thereby generating said shock wave which is thereafter imparted to said cleaving means.

8. The cleaving machine as defined by claim 7 wherein said hammer mechanism includes a movable block member (18) coupled to said means for selectively adjusting the level of bias.

9. The cleaving machine as defined by claim 8 wherein said means for adjusting the level of bias comprises bias spring means (28) including means (29, 30) for adjusting the bias of said spring means.

10. The cleaving machine as defined by claim 9 wherein said spring means (28) comprises a calibrated tension spring and said bias adjusting means comprises a threaded rod and sleeve (29) coupled at one end to said tension spring and at the other end to a rotatable knob (30) mounted on said block member (18).

11. The cleaving machine as defined by claim 7 wherein said anvil means comprises a bar type anvil member (21) located beneath said hammer mechanism, at least one coupling element (20) connected between said anvil member and said cleaving means, and bearing means (19) engaging said coupling means for permitting freely slidable movement of said coupling means to impart said shock wave to said cleaving means.

12. The cleaving machine as defined by claim 11 where said anvil means includes two coupling elements (20) in the form of generally cylindrical shafts and said bearing means (19) comprises adjustable linear bearings.

13. The cleaving machine as defined by claim 7 wherein said actuating means includes a rotatable cam (33) and follower (37) mechanism operable to lift said hammer mechanism a predetermined height to descend abruptly and strike said anvil means, thereby generating said shock wave.

14. The cleaving machine as defined by claim 13 wherein said actuating means additionally includes lever means (35) connected to said cam for imparting a rotary motion thereto whereby a slidable plate member (17) forming a part of said hammer mechanism and having said follower (37) mounted thereon causes said hammer mechanism to raise and lower in conformance with an eccentric peripheral surface of said cam.

15. A crystal cleaving machine comprising a vertical axis guided hammer mechanism (17, 18), a sring (28) biasing said hammer mechanism toward an actuated position, means (29, 30) for adjusting the bias force applied by said spring to said hammer mechanism, a crystal cleaving blade (23) having a cleaving edge (24) defining an acute angle to a plane normal to the vertical path of said cleaving blade travel, driving anvil means (19, 20, 21) positioned below the hammer mechanism to be driven thereby while carrying said blade along said vertical path, means (27) for balancing said blade and said anvil means in static equilibrium along said path, vertical axis positioning control means (12) for the hammer mechanism, blade, and anvil means, an underlying crystal body holding fixture (38) including a reference stop face (42) for a crystal body within said fixture and opposing spring-urged guided elements (43, 44) to engage opposite base surfaces of a crystal body (40) within said fixture, horizontal axis positioning control means (14) for said fixture, and a relatively stationary stop (52) beneath said anvil means fixing a limit of penetration for said blade means into said crystal body in conjunction with said vertical axis positioning control means.

16. A crystal cleaving machine as defined in claim 15 wherein said adjusting means includes a rotational screw-threaded spring tension adjusting means (29, 30).

17. A crystal cleaving machine as defined in claim 15 wherein said guided hammer mechanism comprises a slide (17) and a hammer body (18) attached to one side of the slide, said anvil means comprises an anvil (21) beneath the hammer body (18) for engagement therewith when the hammer body descends under bias of said spring (28).

18. A crystal cleaving machine as defined in claim 17 wherein said anvil means comprises a pair of vertical axis parallel shafts (20) depending from said anvil (21), a blade holder (22) attached to the lower end of said shafts and carrying said cleaving blade (23), and linear guide bearings (19) for said shafts fixed to part (15) of said guided hammer mechanism.

19. A crystal cleaving machine as defined in claim 18 wherein said fixed part comprises a baseplate (15) for the guided hammer mechanism attached bodily to the vertical axis positioning control means (12).

20. A crystal cleaving machine as defined in claim 15 wherein said indicator means comprises a dial indicator (49) having a displaceable element (50) in contact with a part of said fixture moved by said horizontal axis positioning control means (14).

21. A crystal cleaving machine as defined in claim 15 wherein said reference stop face comprises a vertically shallow stop face (42) for engaging the crystal body (40) near its base opposite one of said opposing spring-urged guided elements (43) for engaging the opposite side of the crystal body also near its base to allow full propagation of a shock wave generated by said blade (23) and anvil means (21) entirely through the crystal body vertically.

22. A crystal cleaving machine as defined in claim 21, wherein the other spring-urged guide element (44) has a convex surface (45) for engaging the side of the crystal body (40) with pressure only along a line of contact above said zero reference stop face (42).

23. A crystal cleaving machine as defined in claim 22 wherein said crystal body holding fixture further comprises a horizontal support surface (41) for the crystal body (40) at a level slightly below the top of the zero reference stop face (42) and between such stop face and one of said spring-urged guided elements (43).

24. A crystal cleaving machine comprising:

means (23) having an angular cleaving surface (24) for contacting and transmitting a shock wave to one surface of a crystal workpiece (40) at the edge of a fracture plane;

means (42, 43) for holding opposite base surfaces of said crystal workpiece;

means (14) for selectively positioning said holding means relative to said contacting means;

means (20, 21, 22) for carrying said contacting means along a path intersecting said fracture plane and transmitting a shock wave to said contacting means;

means (52) for fixing a limit upon travel of said carrying means along said path toward said workpiece;

means (27) for balancing said carrying and contacting means in a position of static equilibrium along said path;

means (17, 18) for imparting a shock wave to said carrying means;

means (26, 28) for applying a force to drive said shock wave imparting means toward said carrying means;

means (29, 30) for setting the magnitude of said force to a value sufficient to effect cleavage of the workpiece by a single impartation of a shock wave to said carrying means means (33, 35, 37) for releasing said shock imparting means to said force; and means (13, 15) for simultaneously adjusting the position of said contacting means and shock imparting means, to place said cleaving surface in contact with said fracture plane edge without substantial disturbance of said equilibrium position.

* * * * *